US006890189B1

(12) United States Patent
Wu

(10) Patent No.: US 6,890,189 B1
(45) Date of Patent: May 10, 2005

(54) ELECTRICAL CONNECTOR WITH IMPROVED MATING INTERFACE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/797,209

(22) Filed: Mar. 9, 2004

(51) Int. Cl.[7] ..... H01R 12/00
(52) U.S. Cl. ..... 439/76.1; 439/906
(58) Field of Search ..... 439/76.1, 701, 439/906, 352, 610

(56) References Cited

U.S. PATENT DOCUMENTS 5,358,428 A 10/1994 Bixler et al.
5,920,459 A * 7/1999 Weber et al. ..... 361/752
5,975,957 A 11/1999 Noda et al.
6,290,530 B1 * 9/2001 Chang ..... 439/378
6,319,040 B1 * 11/2001 Chang ..... 439/352
6,328,588 B1 * 12/2001 Tsai et al. ..... 439/352
6,565,366 B1 * 5/2003 Wu ..... 439/76.1
6,589,066 B1 * 7/2003 Wu ..... 439/352
6,592,391 B1 * 7/2003 Wu ..... 439/352
6,619,987 B2 * 9/2003 Kumamoto et al. ..... 439/610
6,641,425 B1 * 11/2003 Wu ..... 439/352
6,641,429 B1 * 11/2003 Wu ..... 439/465
6,648,665 B1 * 11/2003 Wu ..... 439/352
6,648,666 B1 * 11/2003 Wu ..... 439/352
6,659,790 B1 * 12/2003 Wu ..... 439/352
6,663,415 B1 * 12/2003 Wu ..... 439/460
6,663,428 B1 * 12/2003 Wu ..... 439/608
6,666,696 B1 * 12/2003 Wu ..... 439/108
6,685,501 B1 * 2/2004 Wu et al. ..... 439/497
6,702,602 B2 * 3/2004 Wu ..... 439/352
6,702,603 B2 * 3/2004 Wu ..... 439/352
6,716,057 B1 * 4/2004 Wu ..... 439/497
6,722,912 B2 * 4/2004 Wu ..... 439/352
6,736,667 B1 * 5/2004 Wu ..... 439/484
6,739,904 B2 * 5/2004 Wu ..... 439/497
6,786,763 B2 * 9/2004 Wu ..... 439/497
6,821,140 B2 * 11/2004 Wu ..... 439/362

* cited by examiner

*Primary Examiner*—Ross Gushi
(74) *Attorney, Agent, or Firm*—Wei Te Chung

(57) ABSTRACT

An electrical connector (1) for use with a mating connector includes a base member (10), a cover member (12) and a terminal holder (14). The base member includes a base frame (114), a mating frame (117) integrally formed with the base frame at a front end (105) thereof and an engaging opening (115) defined in middle of upper walls of the base frame and the mating frame. The cover member includes a rib (131) at a front end thereof and a protrusion (132) extending forwardly from the rib. The terminal holder is assembled between the base member and the cover member and includes an insulative housing (141), a plurality of terminals (143) received in the housing and a tongue board (146) extending forwardly from the housing into the mating frame. The mating frame and the protrusion together form a mating interface (15) with the tongue board received therein for accommodating insertion of the mating connector, whereby the electrical connector has good mating performance.

17 Claims, 9 Drawing Sheets

ELECTRICAL CONNECTOR WITH IMPROVED MATING INTERFACE

CROSS-REFERENCE TO RELATED APPLICATIONS

This application is related to U.S. patent application Ser. No. 10/745,825 filed on Dec. 24, 2003 and entitled "CABLE CONNECTOR ASSEMLBY HAVING A LATCH MECHANISM", U.S. patent application Ser. No. 10/226,769 filed on Aug. 23, 2002 and entitled "ELECTRICAL CONNECTOR HAVING AN AUTOMATICALLY RECOVERABLE PULL TAB AND LATCHES" (now U.S. Pat. No. 6,648,665) and U.S. patent application Ser. No. 10/217,636 filed on Aug. 12, 2002 and entitled "ELECTRICAL CONNECTOR HAVING A LATCH MECHANISM" (now U.S. Pat. No. 6,641,425), all of which have the same applicant and assignee as the present invention. The disclosure of these related applications is incorporated herein by reference.

BACKGROUND OF THE INVENTION

1. Field of the Invention

The present invention generally relates to an electrical connector, and more particularly to an electrical connector which provides improved mating interface.

2. Description of Prior Art

With the development of communication and computer technology, high density electrical connectors with conductive elements in a matrix arrangement are desired to construct a large number of signal transmitting paths between two electronic devices. Such high density electrical connectors are widely used in internal connecting systems of servers, routers and the like devices requiring high speed data processing and communication.

One interface of the high density electrical connectors known in the art is the D-shaped interface, for example, as shown in U.S. Pat. No. 5,358,428. Such an interface comprises a metallic shielding shroud encircling a plurality of conductive terminals therein for shielding electrical termination from external electromagnetic interference. The configuration of the shielding shroud is defined by upper and lower elongated shielding walls extending forwardly from the connector, and two oppositely angled end walls which form a substantially trapezoidal shape. The trapezoidal shape provides a polarizing feature for preventing mismating. However, the shielding shroud is made of rigid metal and has a certain thickness. Consequently, when mated with a complementary connector, the shielding shroud could not elastically deform, which will lead to unwanted deformation of a corresponding mating portion of the complementary connector and further adversely affects electrical performance.

Hence, an electrical connector having an improved mating interface is desired to overcome the disadvantages of the prior art.

BRIEF SUMMARY OF THE INVENTION

Accordingly, the object of the present invention is to provide an electrical connector having an improved mating interface which has good mating performance.

In order to achieve the above-mentioned object, an electrical connector for use with a mating connector in accordance with the present invention comprises a base member, a cover member and a terminal holder. The base member comprises a base frame, a mating frame integrally formed with the base frame at a front end thereof, and an engaging opening defined in middle portions of upper walls of the base frame and the mating frame. The cover member is formed with a rib at a front end thereof and a protrusion extending forwardly from the rib. The terminal holder is assembled between the base member and the cover member and comprises an insulative housing, a plurality of terminals received in the housing and a tongue board extending forwardly from the housing into the mating frame. The mating frame and the protrusion together form a mating interface with the tongue board received therein for accommodating insertion of the mating connector, thereby obtaining reliable mating performance.

Other objects, advantages and novel features of the invention will become more apparent from the following detailed description of the present embodiment when taken in conjunction with the accompanying drawings.

DETAILED DESCRIPTION OF THE INVENTION

Figure 1:
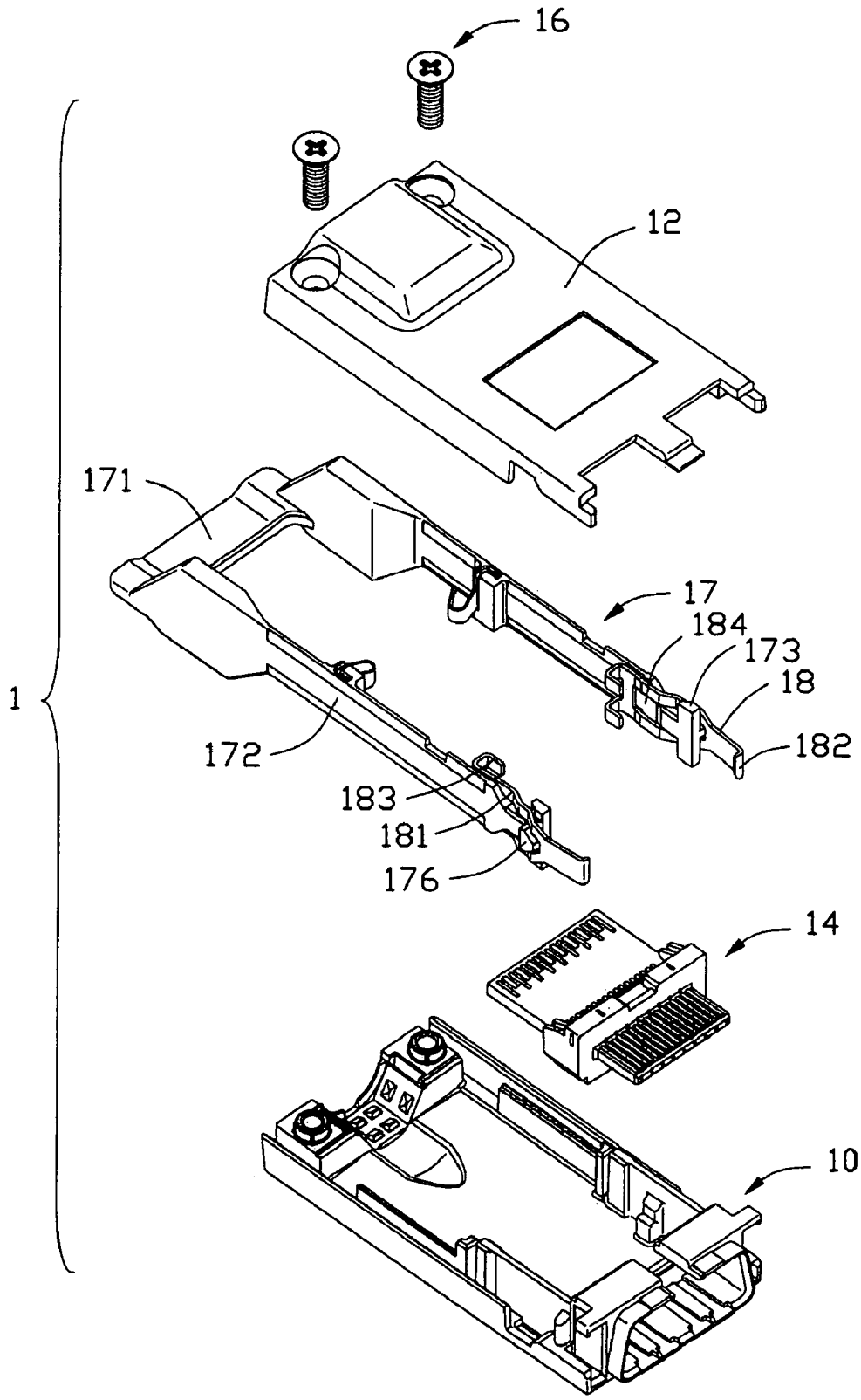
FIG. 1 is an exploded, perspective view of an electrical connector in accordance with the present invention.

Reference will now be made to the drawing figures to describe the present invention in detail.

Referring to FIG. 1, an electrical connector 1 of the present invention comprises a base member 10, a cover member 12 assembled on the base member 10, a terminal holder 14 received in a space defined between the base member 10 and the cover member 12, a pair of screws 16, a pull tab 17 and a pair of latch springs 18.

Figure 2:
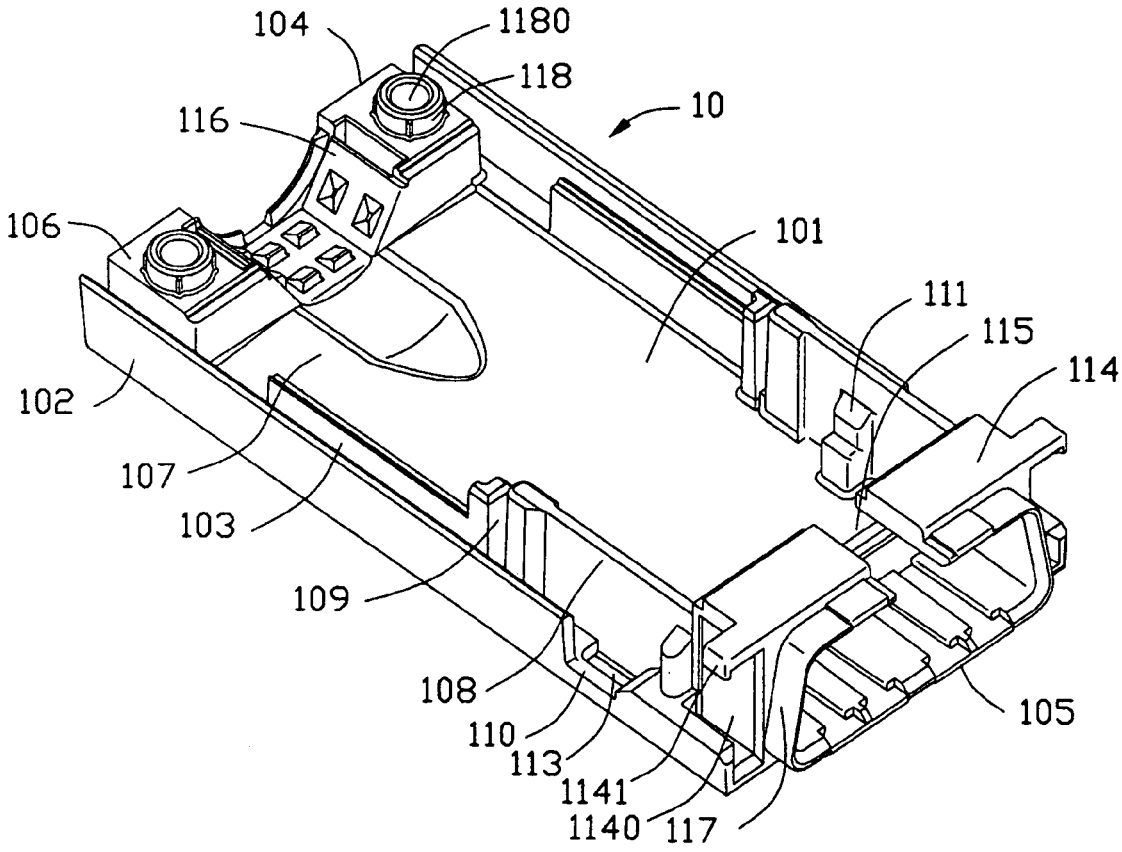
FIG. 2 is an enlarged, perspective view of a base member shown in FIG. 1.
Figure 3:
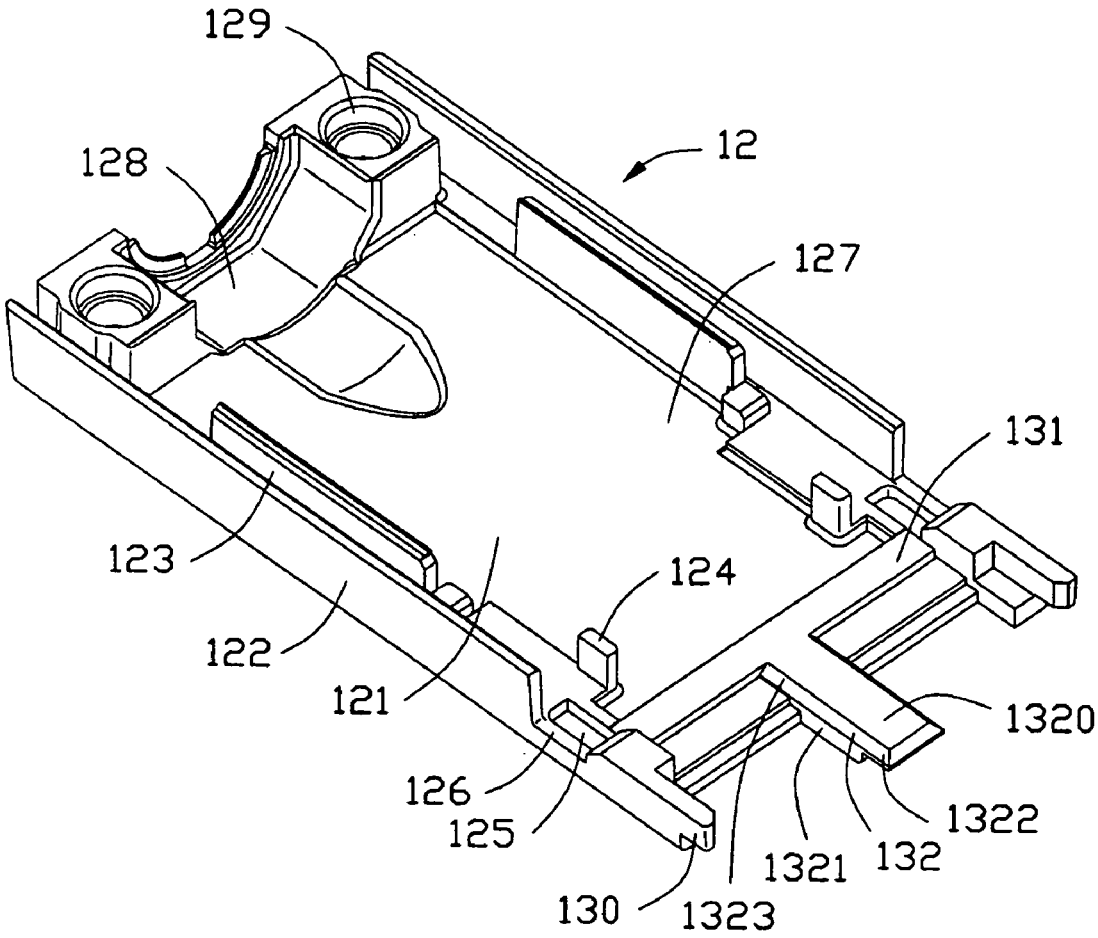
FIG. 3 is an enlarged, perspective view of a cover member shown in FIG. 1.

As best shown in FIGS. 2 and 3, both the base member 10 and the cover member 12 are formed by die casting metallic material, e.g., aluminum alloy. The base member 10 has a receiving space 107 defined by a base plate 101 and a pair of sidewalls 102 which upwardly extend from opposite lateral sides of the base plate 101. Each sidewall 102 defines an elongated channel 103 from a rear end 104 toward a front end 105 and extending through a top engaging face 106 of the base member 10. Each sidewall 102 comprises a shoulder portion 108 and a cutout 110 formed adjacent to the front end 105 at opposite lateral sides of the channel 103. The shoulder portions 108 each define a vertical slit 109 at a rear side thereof. A pair of blocks 111 is further formed on inner sides of the shoulder portions 108 and each block 111 defines thereon a stepped mounting edge for receiving the terminal holder 14, which will be described in greater detail hereinafter.

The base plate 101 of the base member 10 defines a pair of depressions 113 located between the shoulder portions 108 and corresponding cutouts 110. The base member 10 also forms a base frame 114 and a mating frame 117 extending forwardly from the base frame 114 at the front end 105. The mating frame 117 is integrally formed with the base frame 114 and is thinner than the base frame 114. Both of the mating frame 117 and the base frame 114 are interrupted by an engaging opening 115 which is defined in the middle of upper walls thereof. The base frame 114 is formed with a pair of engaging ears 1141 extending laterally from opposite top sides thereof and a pair of engaging channels 1140 in opposite outer sides thereof. At the rear end 104 of the base member 10, a substantially semicircular first opening 116 is provided for the extension of a cable (not shown). A pair of posts 118 each with a screw hole 1180 defined therethrough are arranged at opposite sides of the opening 116, respectively.

Particularly referring to FIG. 3, the cover member 12 defines a receiving space 127 surrounded by a cover plate 121 and a pair of sidewalls 122 extending downwardly from opposite lateral sides of the cover plate 121. Each sidewall 122 defines a channel 123 therealong corresponding to the channel 103 of the base member 10. A pair of projections 130 extend forwardly from opposite sides of a front end of the cover plate 121. A pair of lumps 124 extend downwardly from the cover plate 121 in correspondence with the blocks 111 of the base member 10 for cooperating with the blocks 111 to thereby secure a printed circuit board 142 (FIG. 4) of the terminal holder 14 in appropriate position. A pair of depressions 125, in correspondence with the depressions 113 in the base member 10, is defined in the cover plate 121. Similarly, a pair of cutouts 126 is defined in respective sidewalls 122 corresponding to the cutouts 110 defined in the base member 10. A rib 131 protrudes downwardly from a front end of the cover plate 121 and is adjacent to the pair of depressions 125. A protrusion 132 extends forwardly from a middle portion of the rib 131. A front end of the protrusion 132 is in alignment with front ends of the pair of projections 130. Further, a bottom face 1320 of the protrusion 132 and a bottom surface of the rib 131 are coplanar with each other. The protrusion 132 is formed with a thin forward portion 1322, a middle portion 1321 and a rear portion 1323 connecting with the rib 131. The forward portion 1322 and the mating frame 117 of the base member 10 have equal thickness. A top surface of the middle portion 1321 is coplanar with a top face of the cover plate 121. A substantially semicircular second opening 128 is provided in a rear end of the cover member 12 in correspondence with the first opening 116 of the base member 10. A pair of through-holes 129 is provided on opposite sides of the opening 128, each through-hole 129 having a diameter substantially equal to an outer diameter of each post 118 of the base member 10.

Turning to FIG. 1, the pull tab 17 and the pair of latch springs 18 are engaged with each other. Specifically, each of the latch springs 18 is formed by stamping a metal sheet, and has a body 181, an L-shaped engaging part 182 and a U-shaped hold part 183 oppositely extend from opposite ends of the body 181, respectively. An elongated cutout 184 is defined along the length of the body 181.

The pull tab 17 includes an operable portion 171, a pair of parallel arms 172 extending forwardly from opposite sides of the operable portion 171, and a pair of latch releasing portions 173 formed at distal ends of the arms 172, respectively. Each latch releasing portion 173 has an embossment 176 protruding outwardly from an outer face thereof.

Figure 4:
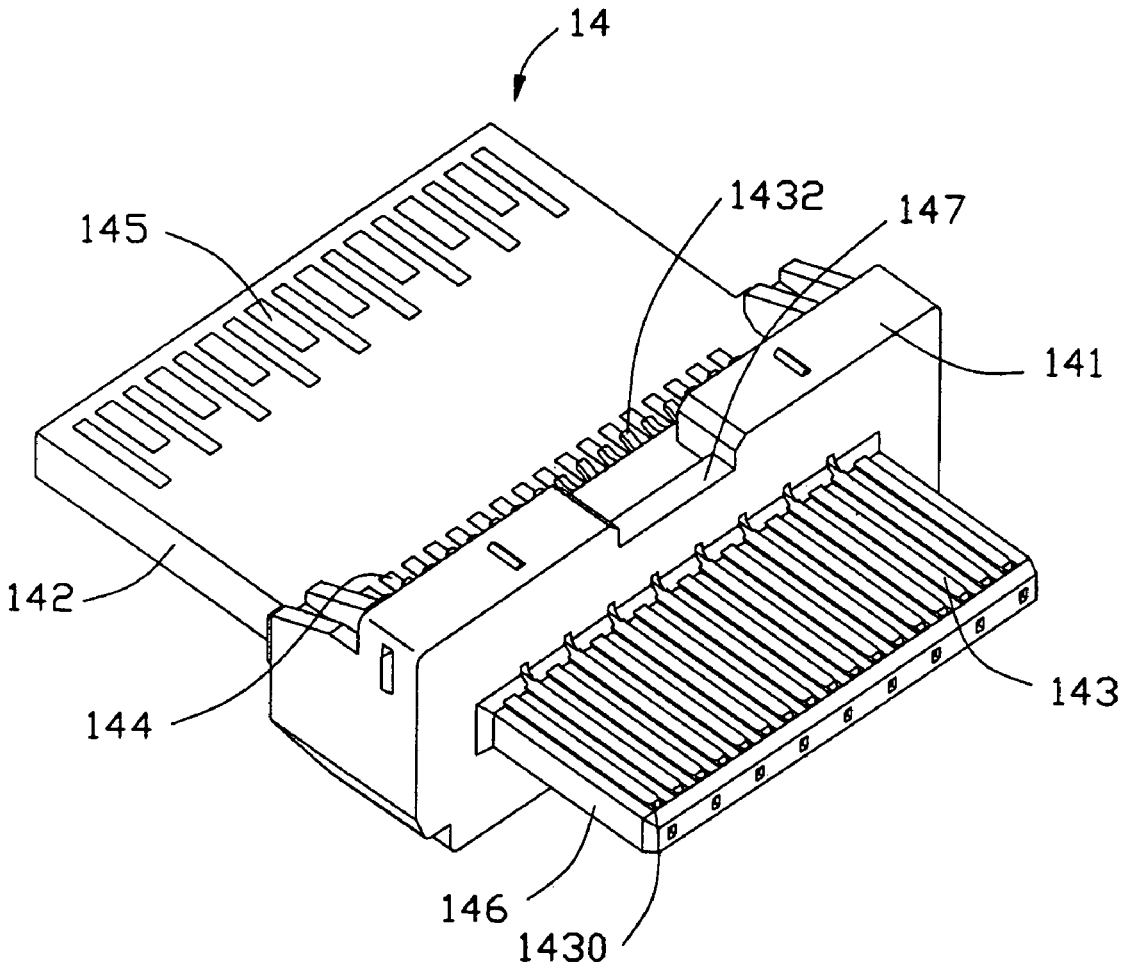
FIG. 4 is an enlarged, perspective view of a terminal holder shown in FIG. 1.
Figure 5:
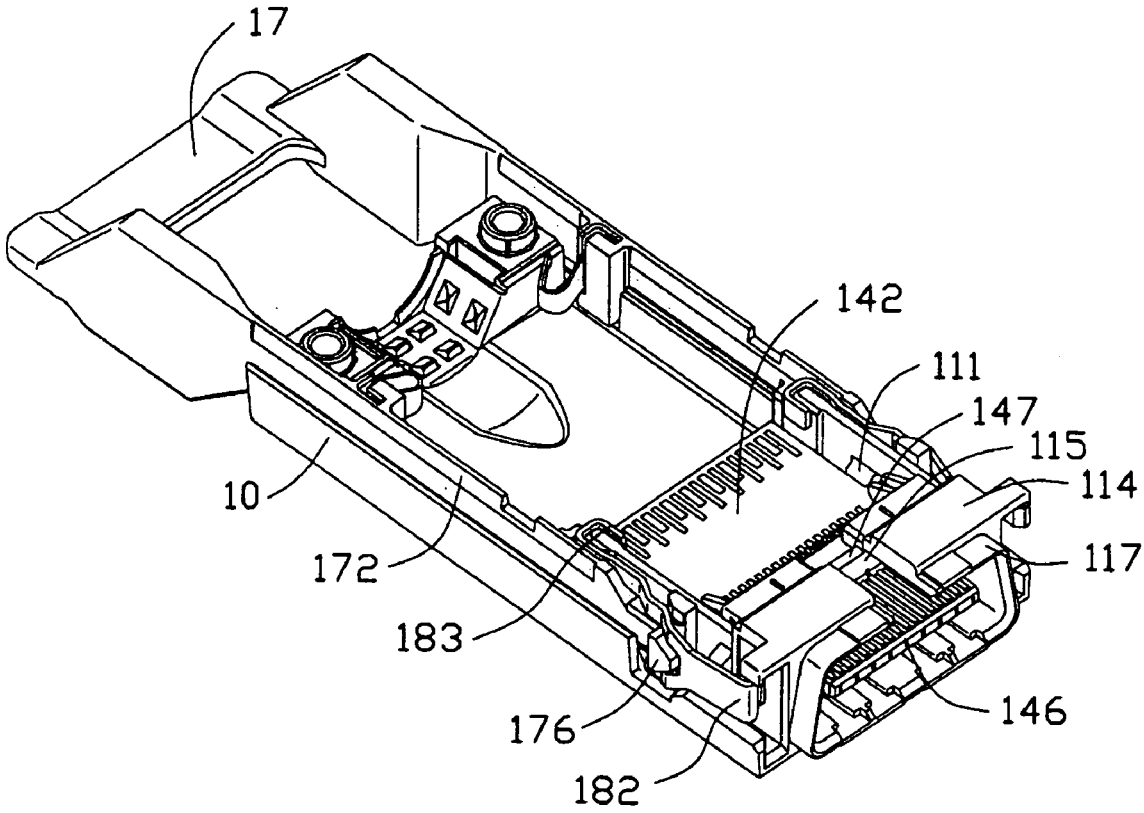
FIG. 5 is a view of the base member of the cable connector assembly of FIG. 2 with a pull tab, a pair of latch springs and the terminal holder of FIG. 4 assembled thereon.
Figure 6:
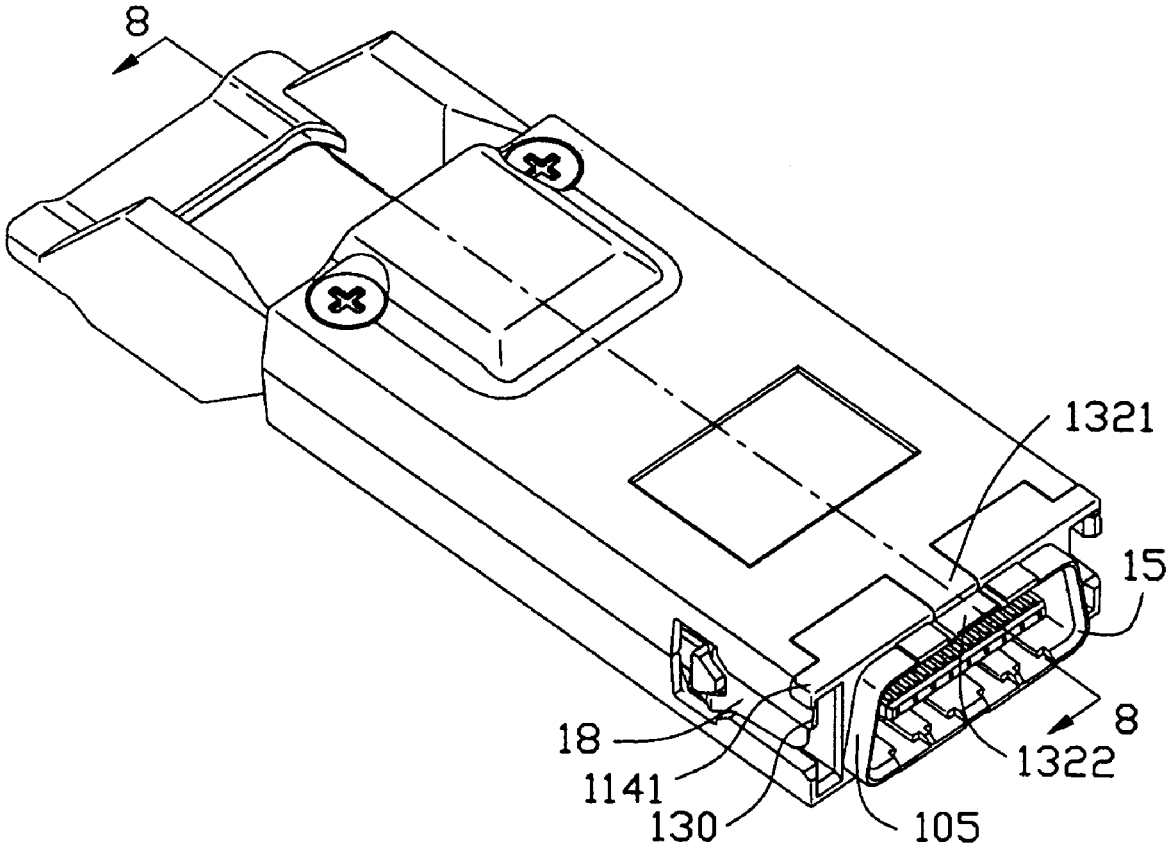
FIG. 6 is an assembled view of the electrical connector shown in FIG. 1.
Figure 7:
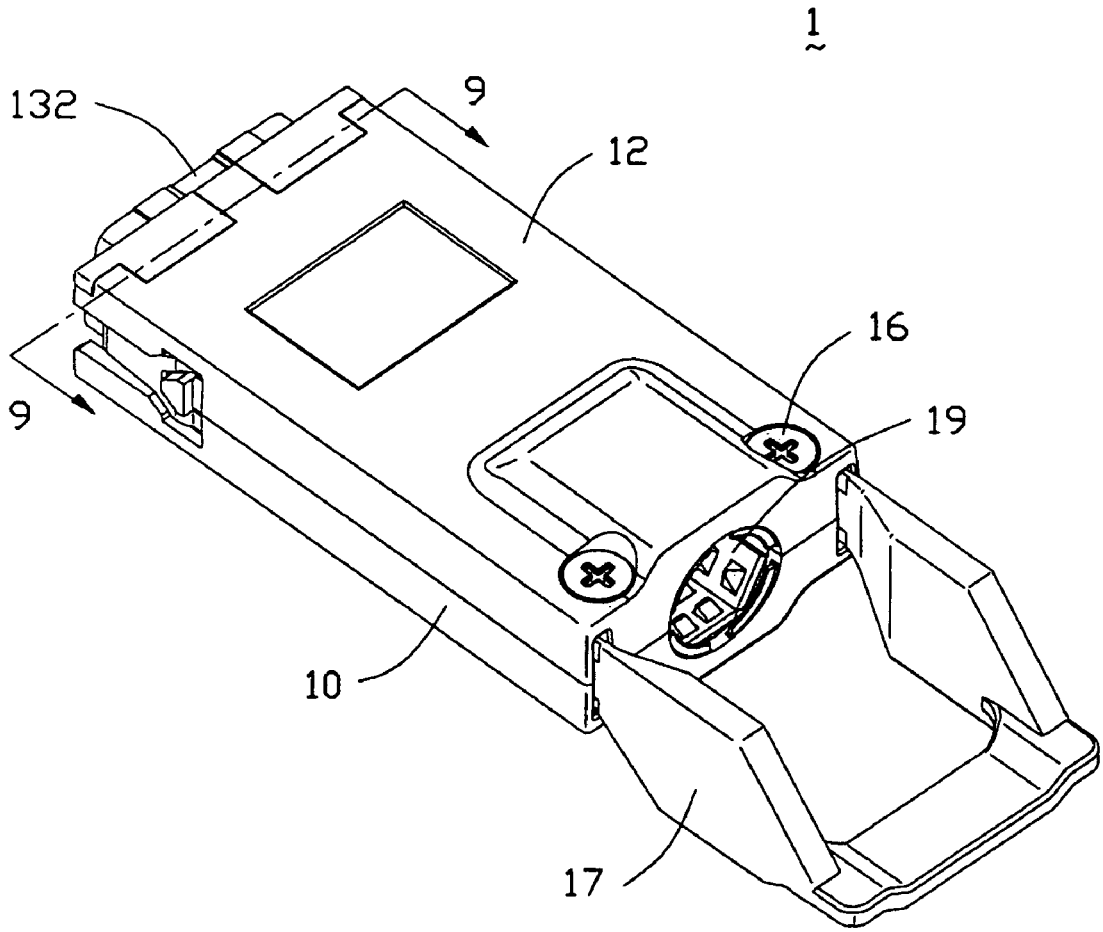
FIG. 7 is a view similar to FIG. 6, but viewed from a different angle.

With reference to FIG. 4, the terminal holder 14 of the electrical connector 1 is shown in detail. The terminal holder 14 is assembled between the base member 10 and the cover member 12 and comprises an insulating housing 141, the printed circuit board 142 assembled onto a rear side of the housing 141, and a plurality of conductive terminals 143 accommodated in the housing 141. The printed circuit board 142 has a number of first conductive pads 144 formed on a forward end of both sides thereof and a number of second conductive pads 145 formed on a rearward end of both sides thereof. Soldering portions 1432 of the terminals 143 are electrically soldered with the first conductive pads 144 and contacting portions 1430 of the terminals 143 are disposed in a tongue board 146 formed at a front end of the housing 141 for electrically connecting with a complementary connector (not shown). A recess 147 is recessed inwardly from a top face of the housing 141 for accommodating the middle portion 1323 of the protrusion 132. The distance from a bottom face of the recess 147 to the top face of the housing 141 is equal to the thickness of the rear portion 1323 of the protrusion 132.

Turning back to FIG. 1 in conjunction with FIGS. 2–7, in assembly, the terminal holder 14 is assembled to the base member 10 with the tongue board 146 placed in the mating fame 117. The printed circuit board 142 is located in the receiving space 107 of the base member 10 and supported by the blocks 111. The two latch springs 18 are respectively assembled to the arms 172 of the pull tab 17 by extending the embossments 176 into the cutouts 184 from inner faces of the latch springs 18, whereby the latch releasing portions 173 engage with the inner faces of the latch springs 18, respectively. Then, the latch springs 18 together with the pull tab 17 are assembled to the base member 10. The arms 172 of the pull tab 17 are placed into the channels 103 of the base member 10 with the operable portion 171 located outside the rear end 104 of the base member 10. The U-shaped, hold part 183 are partially received in the slits 109 of the shoulder portions 108 and engage with the rear ends of the shoulder portions 108 to secure the latch springs 18 on the base member 10. Lower ends of the latch releasing portions 173 are accommodated in corresponding depressions 113. The L-shaped, engaging parts 182 are housed at opposite sides of the front end 105 of the base member 10 for latching with the complementary connector.

Figure 8:
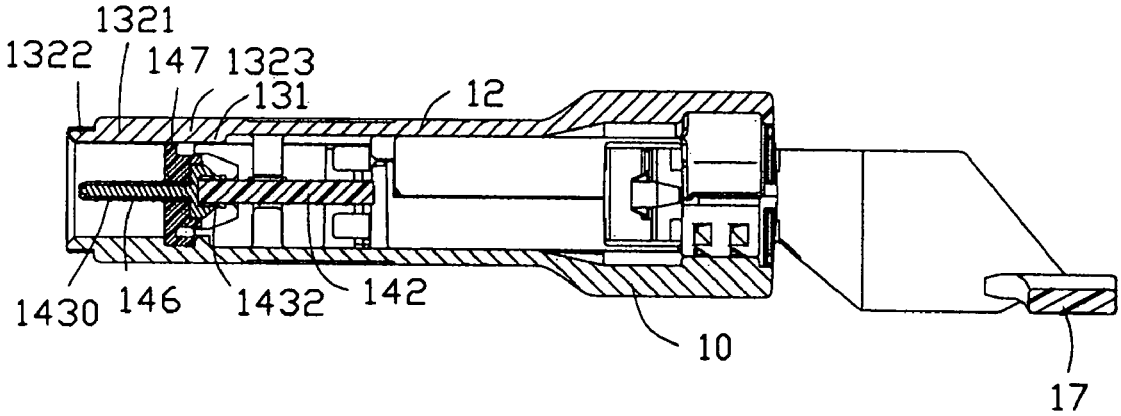
FIG. 8 is a cross-sectional view taken along line 8—8 of FIG. 6.
Figure 9:
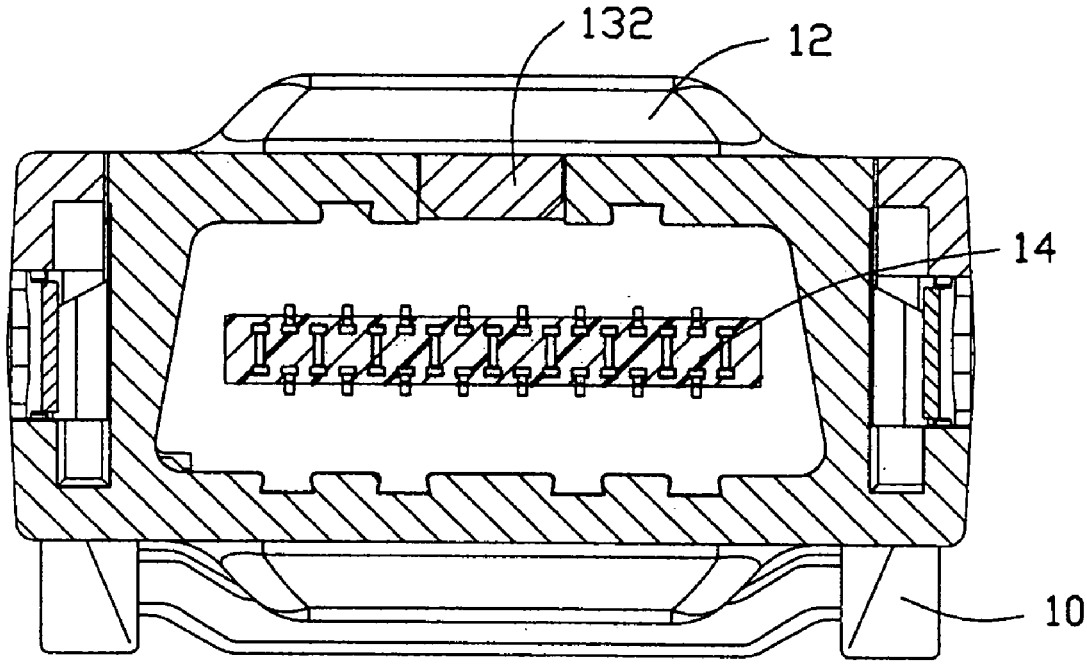
FIG. 9 is a cross-sectional view taken along line 9—9 of FIG. 7.

Referring to FIGS. 2–7 in conjunction with FIGS. 8–9, the cover member 12 is attached onto the base member 10 by placing the projections 130 below the pair of engaging ears 1141. Simultaneously, the protrusion 132 fully fills up the engaging opening 115. The rear portion 1323 is fittingly received in the recess 147 of the terminal holder 14 with a surface thereof intimately abutting against a bottom face of the recess 147, which assists fixation of the terminal holder 14. The top surface of the middle portion 1321 is coplanar with a top face of the base frame 114. Then a rear portion of the cover member 12 is rotated downwardly about the pair of engaging ears 1141 until the bottom face of the cover member 12 intimately abuts the top engaging face 106 of the base member 10. In this manner, the mating frame 117 and the forward portion 1322 of the protrusion 132 together form a D-shaped mating interface 15 with the tongue board 146 of the terminal holder 14 extending therein for accommodating insertion of a mating connector (not shown). The first and the second openings 116, 128 together form a cable receiving opening 19 (FIG. 7) for extension of the cable therethrough. Finally, the pair of screws 16 are put into the through holes 129 and screwed into the screw holes 1180 to securely fasten the cover member 12 and the base member 10 together, whereby the electrical connector 1 in accordance with the present invention is obtained. Since the mating interface 15 is formed with two separate parts, when the mating connector is inserted into the electrical connector 1, the mating interface 15 could expand in lateral direction. In other words, the electrical connector 1 of the present invention provides good mating performance when it is mating with a complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mating with a mating connector, comprising:

a base member having a base frame, a mating frame formed at a front end of the base frame, and an engaging opening defined in upper walls of the base frame and the mating frame;

a cover member having a rib at a front end thereof and a protrusion extending forwardly from the rib; and a terminal holder assembled between the base member and the cover member and comprising an insulative housing, a plurality of terminals received in the housing and a tongue board extending forwardly from the housing into the mating frame;

wherein the protrusion of the cover member fills the engaging opening of the base member, the mating frame and the protrusion together form a mating interface with the tongue board received therein for accommodating insertion of the mating connector, and when the mating connector is inserted into the electrical connector, the mating interface elastically expands in a lateral direction.

2. The electrical connector as described in claim 1, wherein the protrusion of the cover member is formed with a forward portion, a rear portion adjacent to the rib and a middle portion connecting the forward portion and the rear portion.

3. The electrical connector as described in claim 2, wherein the forward portion of the protrusion is thinner than the middle portion.

4. The electrical connector as described in claim 2, wherein the forward portion of the protrusion and the mating frame of the base member have equal thickness.

5. The electrical connector as described in claim 2, wherein the middle portion of the protrusion and the base frame of the base member have equal thickness.

6. The electrical connector as described in claim 2, wherein the terminal holder has a recess at the top thereof for accommodating the rear portion of the protrusion.

7. The electrical connector as described in claim 1, wherein the mating interface has a trapezoidal configuration.

8. The electrical connector as described in claim 1, wherein the base member comprises a pair of engaging ears extending laterally from opposite top sides thereof.

9. The electrical connector as described in claim 8, wherein the cover member comprises a pair of projections extending forwardly from opposite lateral sides thereof, the projections being positioned below the corresponding engaging ears.

10. The electrical connector as described in claim 1, further comprising a pull tab assembled between the base member and the cover member, and a pair of latch springs assembled on the pull tab.

11. An electrical connector comprising:

a horizontal base member and a horizontal cover member complementarily assembled to each other and commonly define an internal space;

an uprightly extending base frame formed on a front portion of the base member, said base frame defining a complete circumference except an engaging opening formed thereof around the cover member;

a terminal holder snugly received in said circumference;

a plurality of terminals disposed in said terminal holder with forwardly extending mating portions for mating with a complementary connector and tail portions for electrically connecting to a cable; and a protrusion formed on a front portion of the cover member and snugly received in said engaging opening so as to cooperate with said base frame to form the complete circumference.

12. The connector as described in claim 11, wherein said terminal holder further defines a recess in vertical alignment with said engaging opening.

13. The connector as described in claim 12, wherein a lower portion of said protrusion is received in said recess, and an upper portion of said protrusion is received in said engaging opening.

14. The connector as described in claim 11, wherein a mating frame extends forwardly from said base frame with a D-shaped periphery.

15. The connector as described in claim 14, wherein said engaging opening extends forwardly through said mating frame and form a cutout in said periphery.

16. The connector as described in claim 15, wherein said protrusion extends forwardly to occupy said cutout.

17. An electrical connector comprising:

a horizontal base member and a horizontal cover member complementarily assembled to each other and commonly define an internal space;

an uprightly extending base frame formed on a front portion of the base member;

a mating frame forwardly extending from said base frame and defining a mating port thereof;

an engaging opening interrupting a periphery of said mating frame in a front-to-back direction;

a terminal holder snugly received in said base frame;

a plurality of terminals disposed in said terminal holder with forwardly extending mating portions for mating with a complementary connector and tail portions for electrically connecting to a cable; and a protrusion formed on a front portion of the cover member and snugly received in said engaging opening so as to cooperate with said mating frame to define a complete periphery of said mating port.

* * * * *